US010788786B2

(12) United States Patent
Kawahito

(10) Patent No.: US 10,788,786 B2
(45) Date of Patent: Sep. 29, 2020

(54) IMAGE FORMING APPARATUS

(71) Applicant: SHARP KABUSHIKI KAISHA, Sakai, Osaka (JP)

(72) Inventor: Hiroshi Kawahito, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/712,583

(22) Filed: Dec. 12, 2019

(65) Prior Publication Data

US 2020/0209802 A1 Jul. 2, 2020

(30) Foreign Application Priority Data

Dec. 27, 2018 (JP) ..... 2018-244629

(51) Int. Cl.
*G03G 21/16* (2006.01)

(52) U.S. Cl.
CPC ..... *G03G 21/1647* (2013.01); *G03G 21/168* (2013.01); *G03G 21/1676* (2013.01)

(58) Field of Classification Search
CPC ..... G03G 15/657; G03G 15/6558; G03G 21/1647; G03G 21/1676; G03G 21/168; G03G 2215/00649; G03G 2215/00675
See application file for complete search history.

(56) References Cited

U.S. PATENT DOCUMENTS 4,464,042 A * 8/1984 Omori ..... B65H 5/36 399/316
4,609,276 A * 9/1986 Mitzutani ..... G03G 15/6558 399/111
4,708,457 A * 11/1987 Shimura ..... G03G 15/165 399/316
4,809,033 A * 2/1989 Ikemoto ..... G03G 15/165 399/111
5,220,396 A * 6/1993 Monma ..... G03G 15/164 271/312
5,268,724 A * 12/1993 Koizumi ..... G03G 15/165 271/251
5,319,432 A * 6/1994 Akashi ..... B65H 5/062 271/229

(Continued)

FOREIGN PATENT DOCUMENTS

JP 60169859 A * 9/1985 ..... G03G 21/1647
JP 2006072178 A * 3/2006 ..... G03G 15/6558
JP 2007-225829 A 9/2007

*Primary Examiner* — David J Bolduc
(74) *Attorney, Agent, or Firm* — ScienBiziP, P.C.

(57) ABSTRACT

Provided is an image forming apparatus including a transfer unit and a development unit. The transfer unit includes a first guide member being a conveyance guide that guides a paper sheet to a transfer nip portion. The first guide member is formed of a conductive metal or the like, and is electrically connected to a grounding current path. The development unit includes a second guide member being a conveyance guide that guides the paper sheet to the transfer nip portion. The second guide member is formed of a conductive metal or the like. The second guide member has an elastic portion that abuts against the first guide member. The elastic portion is elastically deformable in an attaching and detaching direction of the development unit and in an attaching and detaching direction of the transfer unit.

6 Claims, 10 Drawing Sheets

(56) References Cited

U.S. PATENT DOCUMENTS 5,414,492 A * 5/1995 Kubota ..... B41J 13/10 399/111
5,579,097 A * 11/1996 Tomoe ..... G03G 15/2064 399/323
5,592,278 A * 1/1997 Sato ..... G03G 15/164 271/264
5,594,539 A * 1/1997 Murano ..... G03G 15/6558 399/316
5,758,247 A * 5/1998 Yanashima ..... G03G 15/164 399/315
6,125,244 A * 9/2000 Kamiya ..... G03G 15/6558 399/388
6,701,119 B2 * 3/2004 Tomiki ..... G03G 15/6558 399/316
8,346,153 B2 * 1/2013 Ogawa ..... G03G 15/234 399/111
2001/0033760 A1 * 10/2001 Sawanaka ..... G03G 15/6558 399/316
2005/0201789 A1 * 9/2005 Yuminamochi ..... G03G 15/657 399/390
2005/0207802 A1 * 9/2005 Izumi ..... G03G 15/167 399/316
2006/0045580 A1 * 3/2006 Matsuura ..... G03G 15/6558 399/316
2006/0171760 A1 * 8/2006 Deguchi ..... G03G 15/165 400/642
2007/0008397 A1 * 1/2007 Maebashi ..... G03G 15/50 347/158
2007/0147920 A1 * 6/2007 Shimizu ..... G03G 15/657 399/400
2007/0253755 A1 * 11/2007 Inui ..... G03G 15/6567 399/316
2007/0280750 A1 * 12/2007 Kurosu ..... G03G 15/1605 399/316
2007/0297829 A1 * 12/2007 Kurosu ..... G03G 15/6558 399/121
2008/0251991 A1 * 10/2008 Doyo ..... B65H 5/062 271/109
2011/0110684 A1 * 5/2011 Sato ..... G03G 21/168 399/121
2013/0287420 A1 * 10/2013 Taoka ..... G03G 15/6564 399/66
2014/0140727 A1 * 5/2014 Shimoi ..... G03G 21/1633 399/121
2015/0084273 A1 * 3/2015 Shimoi ..... G03G 15/657 271/228
2015/0338788 A1 * 11/2015 Tajiri ..... G03G 15/1665 399/316
2016/0033919 A1 * 2/2016 Egi ..... G03G 15/6529 399/397
2016/0091833 A1 * 3/2016 Okamoto ..... G03G 15/657 399/316
2017/0269512 A1 * 9/2017 Nakajima ..... G03G 15/161
2018/0239288 A1 * 8/2018 Asami ..... G03G 21/06
2018/0267454 A1 * 9/2018 Uno ..... G03G 15/657
2019/0354057 A1 * 11/2019 Okamoto ..... G03G 15/657

* cited by examiner

IMAGE FORMING APPARATUS

BACKGROUND OF THE INVENTION

Field of the Invention

The present invention relates to an image forming apparatus, and more particularly, relates to an image forming apparatus including a sheet guide that guides a sheet to a transfer nip area, and also including a development unit and a transfer unit.

Description of the Background Art

Japanese Unexamined Patent Application Publication No. 2007-225829 discloses an example of an image forming apparatus in the background art. The image forming apparatus in the background art includes a pre-transfer guide that guides a sheet conveyed to the transfer position to a better transfer position, and the pre-transfer guide includes a front surface guide member that guides the front surface of the sheet, and a back surface guide member arranged to face the front surface guide member across a sheet conveyance path. The front surface guide member is made of a conductive material and is grounded through a conductive member. Further, the front surface guide member and the back surface guide member are configured to abut against each other at protrusions formed outside an area of the back surface guide member through which the sheet passes.

In recent years, with miniaturization of image forming apparatuses, a sheet conveyance path has become shorter, and this causes a problem that static electricity charged on a conveyed sheet fails to be sufficiently eliminated before the sheet reaches a transfer position, resulting in transfer defects.

Therefore, there is a type of image forming apparatus in which a conductive member for static elimination is provided in each of a development unit at a printing side and a transfer unit at a non-printing side to efficiently eliminate static electricity charged on a paper surface. In this case, it is desirable to electrically conduct the conductive member at a side of the development unit and the conductive member at a side of the transfer unit to stabilize the surface potential of the sheet.

However, since the development unit and the transfer unit are mounted in the image forming apparatus separately and also the direction in which the development unit and the transfer unit are attached to and detached from the image forming apparatus is different, there is a problem that a configuration for electrically conducting the conductive member at the side of the development unit and the conductive member at the side of the transfer unit is complicated.

Therefore, a main object of the present invention is to provide a novel image forming apparatus.

Another object of the present invention is to provide an image forming apparatus capable of providing reliable conduction between a conductive member at the side of the development unit and a conductive member at the side of the transfer unit to suppress or prevent transfer defects.

SUMMARY OF THE INVENTION

A first invention is an image forming apparatus including an apparatus main body, a development unit, a transfer unit, a first guide member, and a second guide member. The development unit includes an image carrier on which a toner image is formed, and is attached to and detached from the apparatus main body in a longitudinal direction of the image carrier. The transfer unit is placed to face the image carrier, includes a transfer roller that transfers the toner image onto a paper sheet, and is attached to and detached from the apparatus main body in a direction in which the image carrier and the transfer roller face each other. The first guide member is provided in the transfer unit, guides the paper sheet to a transfer nip area formed by the image carrier and the transfer roller, and has conductivity. The second guide member is provided in the development unit, is placed to face the first guide member, guides the paper sheet to the transfer nip area, and has conductivity. At least one of the first guide member and the second guide member is grounded. Further, the image forming apparatus includes an elastic member that is provided between the first guide member and the second guide member, is placed outside a sheet passing area through which the paper sheet passes, and electrically connects the first guide member and the second guide member. The elastic member is elastically deformable in an attaching and detaching direction of the development unit and in an attaching and detaching direction of the transfer unit.

A second invention is dependent on the first invention, wherein the elastic member is a plate spring.

A third invention is dependent on the first or second invention, wherein the elastic member is provided on the front side in the insertion direction of the development unit from the sheet passing area.

A fourth invention is dependent on any one of the first to third inventions, wherein the elastic member is provided integrally with the second guide member.

A fifth invention is dependent on the fourth invention, wherein the elastic member includes a first incline that inclines to approach the first guide member as the first incline moves toward a back side in the insertion direction of the development unit, and a second incline that is formed on the back side of the first incline in the insertion direction of the development unit and inclines to approach the second guide member as the second incline moves toward the back side in the insertion direction of the development unit, and a coupling portion between the first incline and the second incline of the elastic member abuts against the first guide member.

A sixth invention is dependent on any one of the first to fifth inventions, wherein the image forming apparatus further includes an urging member that is provided in the transfer unit and that urges the second guide member in a direction toward the development unit.

According to the present invention, it is possible to provide reliable conduction between the conductive member at the side of the development unit and the conductive member at the side of the transfer unit to suppress or prevent transfer defects.

The above object, other objects, features, and advantages of the present invention will become more apparent from the following detailed description of embodiments with reference to the drawings.

DESCRIPTION OF THE PREFERRED EMBODIMENTS

First Embodiment

Figure 1:
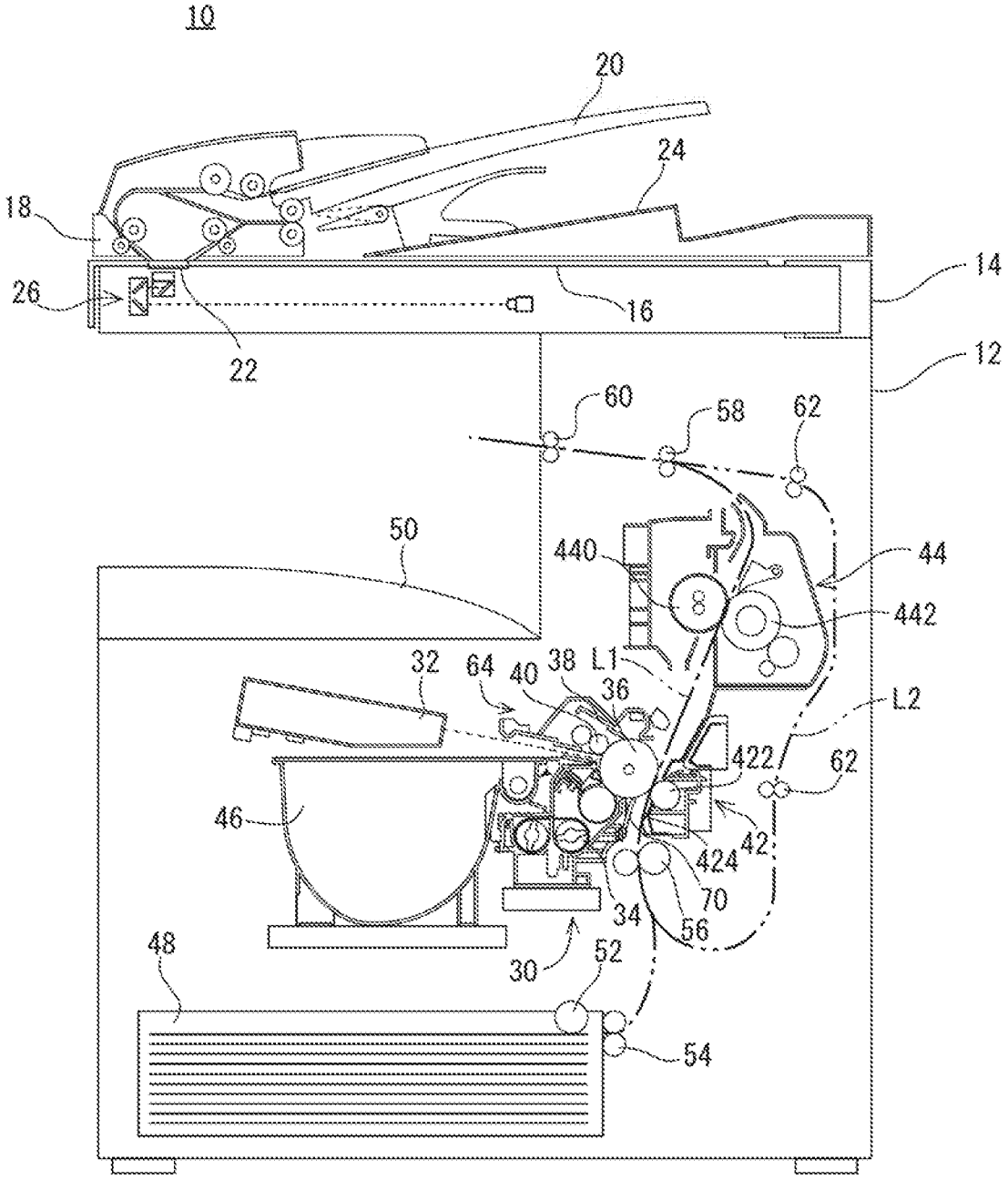
FIG. 1 is an illustrative view illustrating a simplified configuration of an image forming apparatus according to a first embodiment of the present invention, when viewed from the front.
Figure 2:
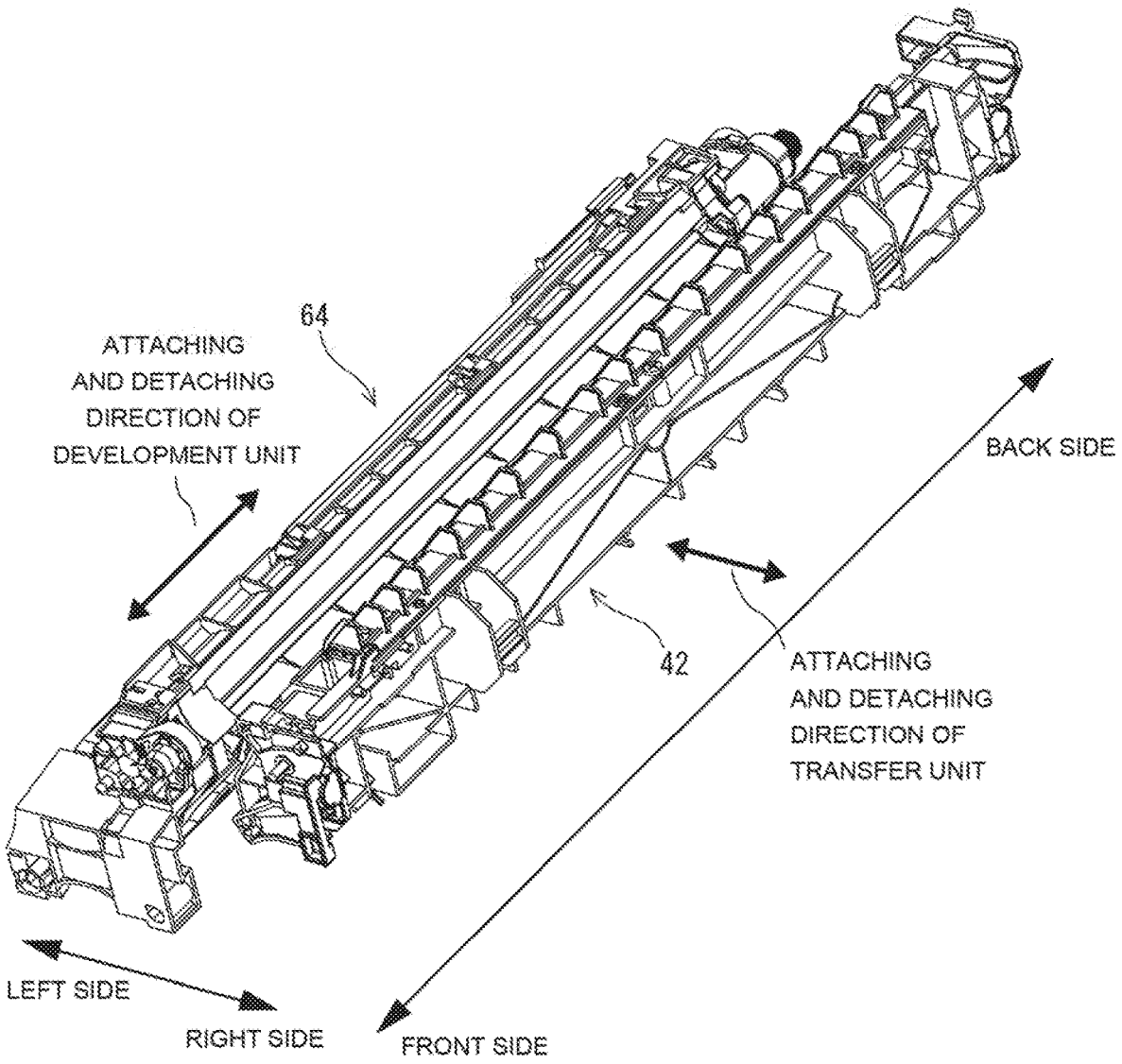
FIG. 2 is an illustrative view illustrating attaching and detaching directions of a development unit and a transfer unit.

FIG. 1 is an illustrative view illustrating a simplified configuration of an image forming apparatus 10 according to a first embodiment of the present invention. FIG. 2 is an illustrative view illustrating attaching and detaching directions of a development unit 64 and a transfer unit 42. The image forming apparatus 10 illustrated in FIG. 1 is a multifunctional apparatus having a copying function, a printer function, a scanner function, a facsimile function, and the like, and forms a monochrome image on a recording medium by an electrophotographic method. It is noted that, as a recording medium, a paper sheet, an overhead projector sheet, or the like can be used, but a case where a paper sheet is used will be described below.

In this specification, the left side is defined as the left direction, and the right side is defined as the right direction in the horizontal directions when the image forming apparatus 10 is viewed from the front. Further, the front side of the image forming apparatus 10 is defined as the head direction (front direction), and the back side of the image forming apparatus 10 is defined as the rear direction (back direction) in the depth directions when the image forming apparatus 10 is viewed from above (below).

First, a configuration of the image forming apparatus 10 will be schematically described. As illustrated in FIG. 1, the image forming apparatus 10 includes: an apparatus main body 12 including an image former 30; and an image reading device 14 placed above the apparatus main body 12.

The image reading device 14 includes a document platen 16 formed of a transparent material. A document pressing cover 18 is attached above the document platen 16 through a hinge or the like to be freely opened and closed. A document feed tray 20 is provided on the upper surface of the document pressing cover 18, and an automatic document feeder (ADF) is provided therein. The ADF automatically feeds documents placed on the document feed tray 20 one by one to an image reading position 22 and discharges them to a document discharge tray 24.

Further, an image reader 26 built in the image reading device 14 includes a light source, a plurality of mirrors, an imaging lens, a line sensor, and the like. The image reader 26 exposes a document surface with a light source, and guides reflected light reflected from the document surface to the imaging lens by a plurality of mirrors. Then, the reflected light is imaged on a light receiving element of the line sensor by the imaging lens. The line sensor detects the luminance and chromaticity of the reflected light imaged on the light receiving element, and image data is generated based on the image on the document surface. As the line sensor, a charge coupled device (CCD), a contact image sensor (CIS), or the like is used.

An operation panel (not illustrated) that receives an input operation such as a print instruction from a user is provided on the front side of the image reading device 14. The operation panel has a display with a touch panel, a plurality of operation buttons, and the like.

Further, the apparatus main body 12 is provided with a controller (not illustrated) including a CPU, a memory, and the like. The controller transmits a control signal to each part of the image forming apparatus 10 based on an input operation to the operation panel, or the like, and causes the image forming apparatus 10 to execute various operations.

The image former 30 includes an exposure unit (light scanning unit) 32, a developing device 34, a photoreceptor drum 36, a cleaner unit (cleaning unit) 38, a charging unit 40, the transfer unit 42, a fixing unit 44, a toner supply device 46, and the like, forms an image on a paper sheet conveyed from a sheet feed tray 48 and the like, and discharges the paper sheet on which the image has been formed to a sheet discharge tray 50. For image data for forming an image on a paper sheet, image data read by the image reader 26 or image data transmitted from an external computer is used.

The photoreceptor drum 36 is an image carrier in which a photosensitive layer is formed on the surface of a cylindrical base body having conductivity, and is configured to be rotated about its axis by a rotation drive source (not illustrated) such as a motor. The charging unit 40 charges the surface of the photoreceptor drum 36 to a predetermined potential. The exposure unit 32 is configured as a laser scanning unit (LSU) having a laser emitter, a reflection mirror, and the like, and exposes the charged surface of the photoreceptor drum 36 to form an electrostatic latent image corresponding to image data on the surface of the photoreceptor drum 36. The developing device 34 includes a developing tank for containing toner, supplies the toner to the surface of the photoreceptor drum 36, and visualizes the electrostatic latent image formed on the surface of the photoreceptor drum 36 with the toner (forms a toner image). It is noted that a toner concentration detection sensor for detecting a toner concentration is provided inside the developing tank. If the toner concentration detected by the toner concentration detection sensor becomes lower than a predetermined value, toner is supplied from the toner supply device 46 to the developing tank. The cleaner unit 38 includes a cleaning blade abutting against the surface of the photoreceptor drum 36 and removes toner remaining on the surface of the photoreceptor drum 36 after development and image transfer.

However, in the image forming apparatus 10 of the first embodiment, the developing device 34, the photoreceptor drum 36, the charging unit 40, and the cleaner unit 38 are further unitized, and a development unit 64 including them is provided to be attachable to and detachable from the apparatus main body 12. Further, as illustrated in FIG. 2, the development unit 64 can be attached to and detached from (inserted into and removed from) the apparatus main body 12 in the longitudinal direction (front-rear direction) of the photoreceptor drum 36 (development unit 64).

Returning to FIG. 1, the transfer unit 42 is a unit that is placed on the right side of the development unit 64 and transfers a toner image formed on the surface of the photoreceptor drum 36 onto a paper sheet. The transfer unit 42 includes a transfer roller 422. The transfer roller 422 is placed to face the photoreceptor drum 36 and is provided to press the photoreceptor drum 36. At the time of image formation, a predetermined voltage is applied to the transfer roller 422 to form a transfer electric field between the photoreceptor drum 36 and the transfer roller 422. Then, the effect of the transfer electric field causes the toner image formed on the outer peripheral surface of the photoreceptor drum 36 to be transferred to a paper sheet while the paper sheet passes through a nip area (transfer nip portion) between the photoreceptor drum 36 and the transfer roller 422.

The transfer unit 42 is fixed to a right cover (not illustrated) provided on the right side surface of the apparatus main body 12. The right cover is provided to be pulled out to the right. That is, the right cover is provided to be openable and closable in the left-right direction with respect to the apparatus main body 12, and the transfer unit 42 is attached to and detached from the apparatus main body 12 in accordance with the opening and closing operation of the right cover. Therefore, as illustrated in FIG. 2, the transfer unit 42 is attached and detached in the left-right direction (the direction in which the photoreceptor drum 36 and the transfer roller 422 face each other).

Returning to FIG. 1, the fixing unit 44 includes a heat roller 440 and a pressure roller 442, and is placed above the transfer unit 42. The heat roller 440 is set to have a predetermined fixing temperature, and the toner image transferred onto the paper sheet is melted, mixed, and pressed when the paper sheet passes through a nip area (fixing nip portion) between the heat roller 440 and the pressure roller 442, so that the toner image is thermally fixed to the paper sheet.

Further, in such an apparatus main body 12, a first sheet conveyance path L1 is formed for sending the paper sheet placed on the sheet feed tray 48 to the sheet discharge tray 50 via the transfer nip portion and the fixing nip portion. Further, in the apparatus main body 12, when duplex printing is performed on a paper sheet, a second sheet conveyance path L2 is formed for returning the paper sheet that has been subjected to single-sided printing and then passed through the fixing nip portion to the first sheet conveyance path L1 on the upstream side of the transfer nip portion in the sheet conveyance direction. In the first sheet conveyance path L1, a registration roller 56 is provided, and also in the first sheet conveyance path L1 and the second sheet conveyance path L2, a plurality of conveyance rollers 58 and 62 are provided, as appropriate, for giving a driving force to the paper sheet in an auxiliary manner.

When single-sided printing is performed in the apparatus main body 12, a paper sheet placed on the sheet feed tray 48 is guided to the first sheet conveyance path L1 one by one by a pickup roller 52 and a separation roller 54, and conveyed to the registration roller 56. Then, the registration roller 56 conveys the paper sheet to the transfer nip portion at a timing when the leading end of the paper sheet and the leading end of the image information (toner image) on the photoreceptor drum 36 are aligned, and the toner image is transferred onto the paper sheet. Thereafter, the paper sheet passes through the fixing nip portion, so that unfixed toner on the paper sheet is thermally fixed. The paper sheet that has been thermally fixed is conveyed through the first sheet conveyance path L1 by the conveyance roller 58 and a discharge roller 60, and is discharged to the sheet discharge tray 50.

On the other hand, when duplex printing is performed, the discharge roller 60 is rotated in reverse when the trailing end of the paper sheet that has been subjected to the single-sided printing and then passed through the fixing nip portion reaches the discharge roller 60, so that the paper sheet is conveyed in the opposite direction to be guided to the second sheet conveyance path L2. The paper sheet, when arriving at the second sheet conveyance path L2, is conveyed through the second sheet conveyance path L2 by the conveyance roller 62, and is guided to the first sheet conveyance path L1 on the upstream side of the registration roller 56 in the sheet conveyance direction. At this time, the front and back sides of the paper sheet are reversed, and thereafter, the paper sheet passes through the transfer nip portion and the fixing nip portion, whereby printing is performed on the back surface of the paper sheet.

It is noted that, to the image forming apparatus 10 as described above, a manual sheet feed tray or an external sheet feed unit may be attached. In such a case, in place of the sheet feed tray 48, paper sheets may be fed from the manual sheet feed tray or the external sheet feed unit to the first sheet conveyance path L1.

In the conventional image forming apparatus configured as described above, the sheet conveyance path tends to be shortened in recent years as the image forming apparatus is downsized. If the sheet conveyance path is short, the static electricity charged on a paper sheet may not be sufficiently eliminated before the paper sheet reaches the transfer position. As described above, the effect of the transfer electric field causes a toner image formed on the outer peripheral surface of the photoreceptor drum 36 to be transferred to a paper sheet while the paper sheet passes through the transfer nip portion. Here, if the paper sheet passes through the transfer nip portion while the paper sheet is charged with static electricity, there are problems that it is difficult to transfer the toner image onto the charged portion of the paper sheet and also transfer defects occur such as jitter (a horizontal black band) formed at the trailing end of the paper sheet.

Therefore, there is a type of image forming apparatus in which a conductive member for static elimination is provided in each of the development unit on the printing side and the transfer unit on the non-printing side. In this case, to stabilize the surface potential of the paper sheet, it is desirable to electrically conduct the conductive member at the side of the development unit and the conductive member at the side of the transfer unit.

However, since the development unit and the transfer unit are attached to the image forming apparatus separately and also the direction in which the development unit and the transfer unit are attached to and detached from the apparatus main body of the image forming apparatus is different, there is a problem that the configuration for electrically conducting the conductive member at the side of the development unit and the conductive member at the side of the transfer unit is complicated. Therefore, in the first embodiment, the development unit 64 and the transfer unit 42 have the following configurations.

Figure 3:
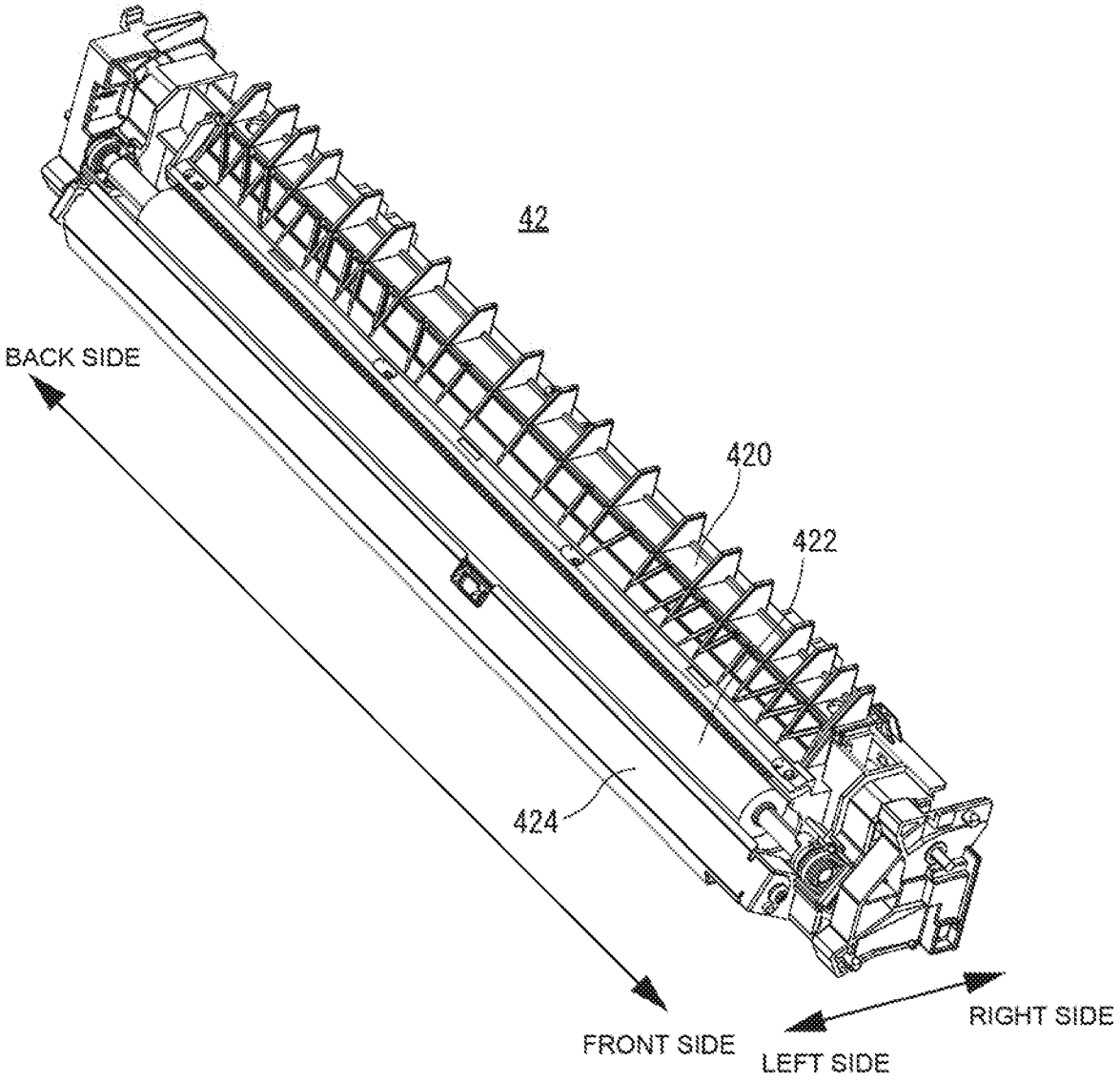
FIG. 3 is a perspective view illustrating a structure of the transfer unit.
Figure 4:
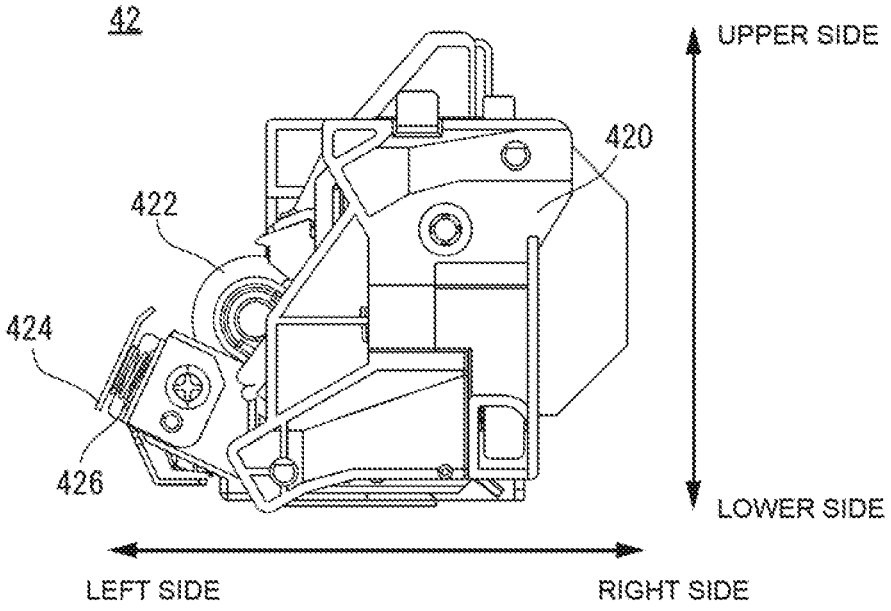
FIG. 4 is a front view illustrating the structure of the transfer unit in FIG. 3.
Figure 5:
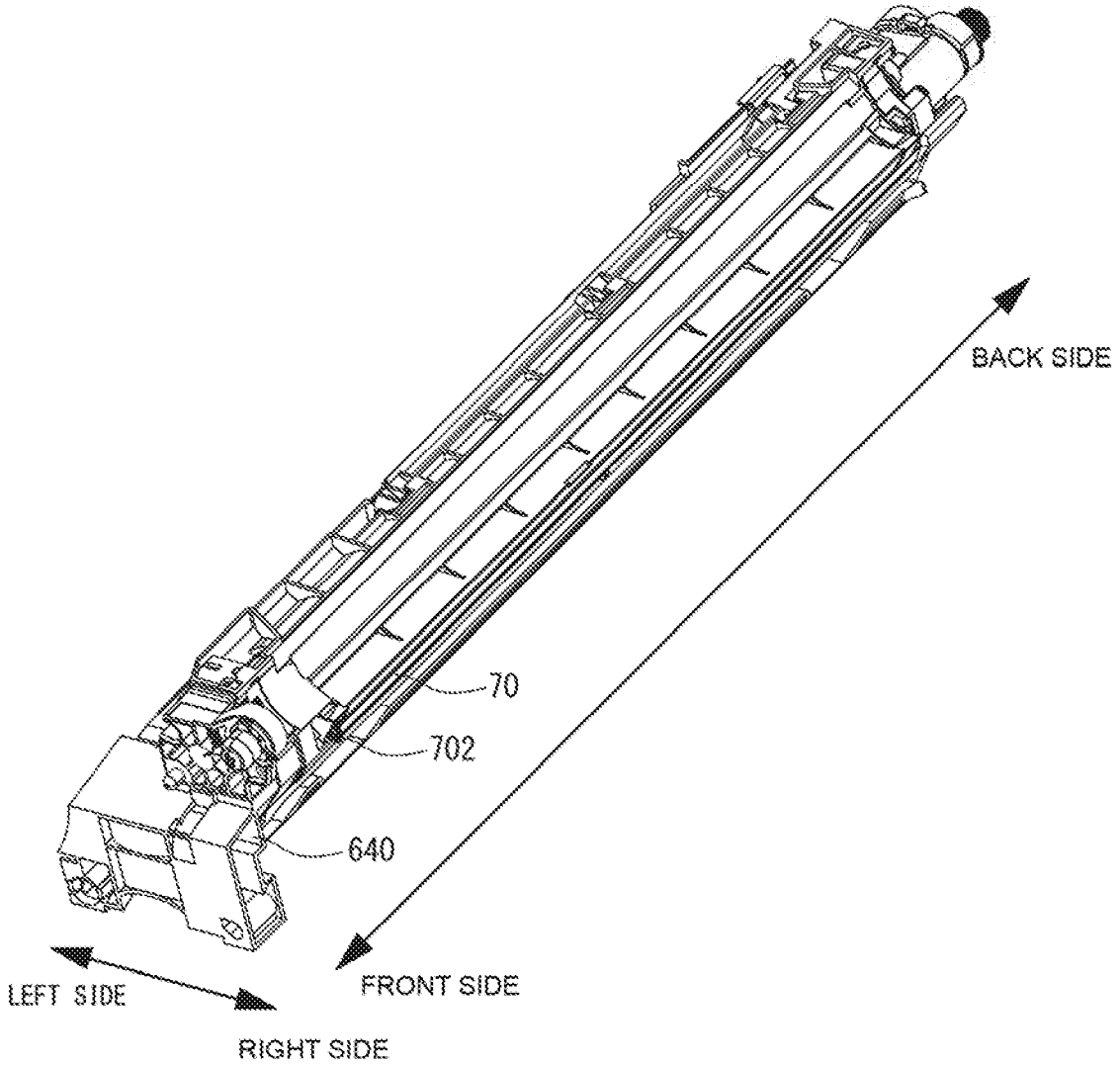
FIG. 5 is a perspective view illustrating a structure of the development unit.
Figure 6:
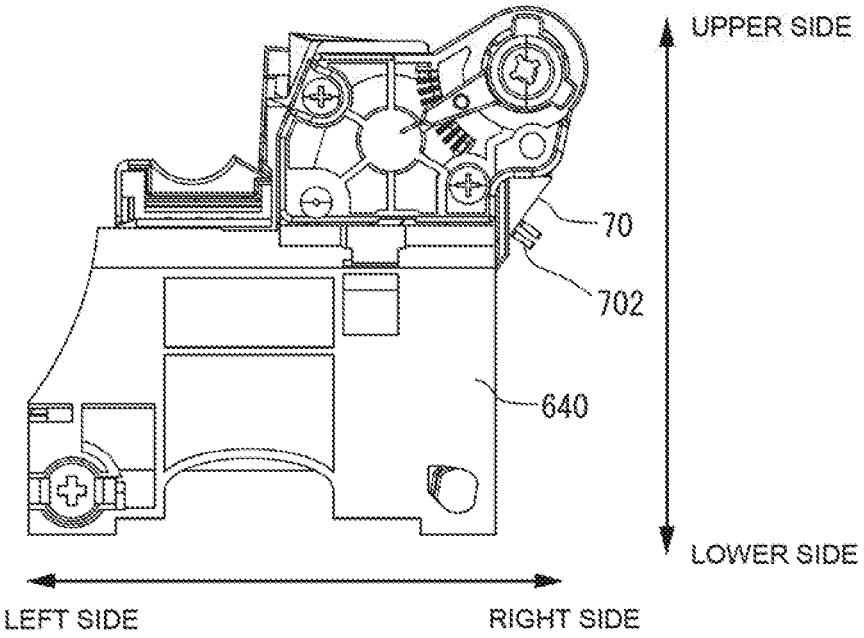
FIG. 6 is a front view illustrating the structure of the development unit in FIG. 5.
Figure 7:
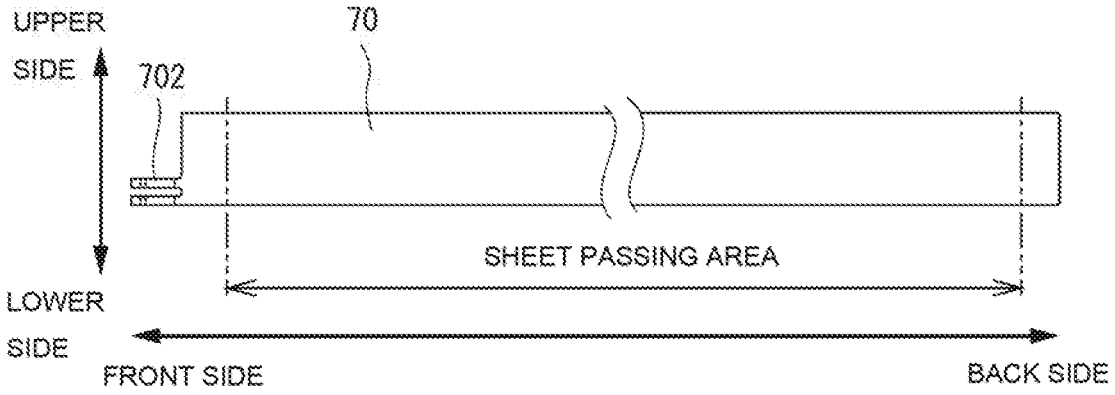
FIG. 7 is an illustrative view illustrating a configuration of a second guide member.
Figure 8A:
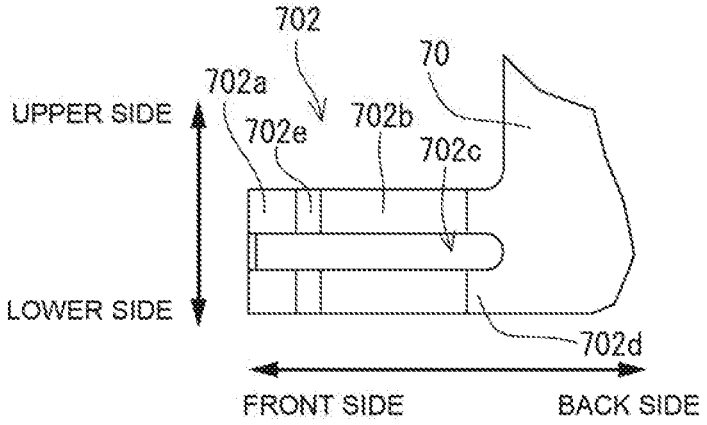
FIG. 8A is a right side view illustrating a configuration of an elastic portion.
Figure 8B:
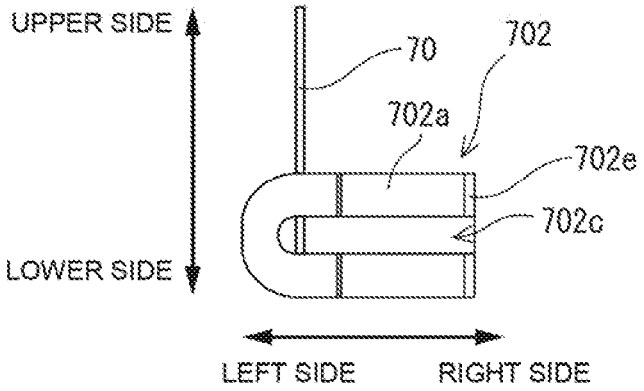
FIG. 8B is a front view illustrating the configuration of the elastic portion.
Figure 8C:
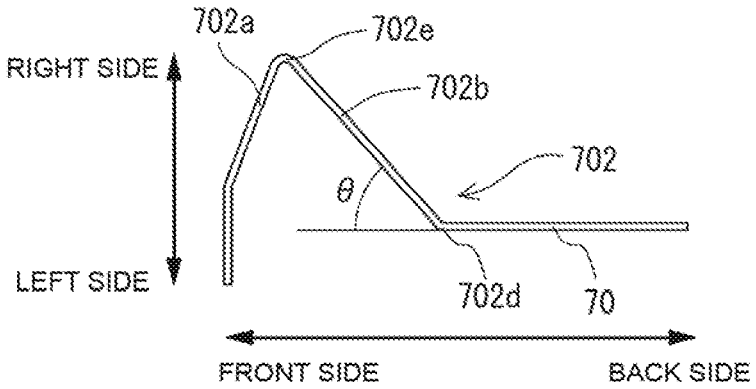
FIG. 8C is a bottom view illustrating the configuration of the elastic portion.

FIG. 3 is a perspective view illustrating a structure of the transfer unit 42. FIG. 4 is a front view illustrating the structure of the transfer unit 42 in FIG. 3. FIG. 5 is a perspective view illustrating a structure of the development unit 64. FIG. 6 is a front view illustrating the structure of the development unit 64 in FIG. 5. FIG. 7 is an illustrative view illustrating a configuration of a second guide member 70. FIG. 8A is a right side view illustrating a configuration of an elastic portion 702. FIG. 8B is a front view illustrating the configuration of the elastic portion 702. FIG. 8C is a bottom view illustrating the configuration of the elastic portion 702.

As illustrated in FIGS. 3 and 4, the transfer unit 42 includes a transfer housing 420, a first guide member 424, and an urging member 426 in addition to the transfer roller 422 described above. The transfer roller 422, the first guide member 424, the urging member 426, and the like are integrally held by the transfer housing 420 in a predetermined arrangement fashion. Further, the transfer housing 420 is held by a right cover provided on the right side surface of the apparatus main body 12.

The first guide member 424 is a conveyance guide that is provided to face the first sheet conveyance path L1 and guides a paper sheet conveyed by the registration roller 56 to the transfer nip portion, and is formed of a conductive metal or the like in a long plate shape. The first guide member 424 is also formed in a flat plate shape that is substantially parallel to the rotation axis of the transfer roller 422. Both ends of the first guide member 424 in the longitudinal direction are held to be attachable to and detachable from the transfer housing 420 by engagement or the like. Further, the first guide member 424 is provided in a region corresponding to at least the transfer roller 422 in the longitudinal direction (front-rear direction) of the transfer roller 422 (transfer unit 42). In other words, the first guide member 424 is provided in a region corresponding to at least a sheet passing area that contacts the paper sheet. However, the first guide member 424 extends to the outside of the sheet passing area, that is, regions corresponding to non-sheet passing areas around the sheet passing area.

The urging member 426 abuts against the right side surface of the first guide member 424, and urges the first guide member 424 in a direction toward the development unit 64 (first sheet conveyance path L1) with a predetermined pressure. For example, the urging member 426 is a compression coil spring, and has a cylindrical shape in which a wire material made of a conductive metal or the like is spirally wound. The urging member 426 is also electrically connected to a grounding current path. Although not illustrated, the grounding current path includes a resistor and the like, and is grounded via a metal frame of the apparatus main body 12 and the like. Further, as described above, since the urging member 426 and the first guide member 424 abut against each other, the first guide member 424 is electrically connected to the grounding current path via the urging member 426. That is, the first guide member 424 is grounded. Therefore, the first guide member 424 also functions as a static elimination member that eliminates the static electricity charged in a paper sheet when the paper sheet conveyed through the first sheet conveyance path L1 is guided.

As illustrated in FIGS. 5 and 6, the development unit 64 includes a development housing 640 and the second guide member 70 in addition to the components described above. In FIGS. 5 and 6, for the sake of simplicity, the photoreceptor drum 36, the charging unit 40, and the cleaner unit 38 are omitted. The development housing 640 integrally holds the components of the development unit 64 such as the second guide member 70 in a predetermined arrangement fashion. Further, a developing tank for containing toner is formed inside the development housing 640.

The second guide member 70 is a conveyance guide that is provided to face the first sheet conveyance path L1 and guides a paper sheet conveyed by the registration roller 56 to the transfer nip portion, and is formed of a conductive metal or the like in a long plate shape. The second guide member 70 is also formed in a flat plate shape substantially parallel to the rotation axis of the photoreceptor drum 36, and is placed at a position facing the first guide member 424. In other words, the first guide member 424 and the second guide member 70 are placed to face each other across the first sheet conveyance path L1, the first guide member 424 guides a non-printing surface of a paper sheet (a surface not in contact with the photoreceptor drum 36), and the second guide member 70 guides a printing surface of the paper sheet (a surface in contact with the photoreceptor drum 36).

Further, both ends of the second guide member 70 in the longitudinal direction are held to be attachable to and detachable from the development housing 640 by fastening or engagement. The second guide member 70 is also provided at least in a region corresponding to the sheet passing area in the longitudinal direction (front-rear direction) of the photoreceptor drum 36 (development unit 64). However, the second guide member 70 extends to the outside of the sheet passing area, that is, regions corresponding to non-sheet passing areas around the sheet passing area (see FIG. 7).

As illustrated in FIGS. 5 to 7, the second guide member 70 also has the elastic portion 702. In this embodiment, the elastic portion 702 is provided integrally with the second guide member 70. The elastic portion 702 is a plate spring, and is provided outside the sheet passing area (in the non-sheet passing area). Specifically, the elastic portion 702 is provided on the front side of the sheet passing area, that is, on the front side in the insertion direction of the development unit 64. The elastic portion 702 is provided at the lower end portion of the second guide member 70 in the vertical direction. In other words, the elastic portion 702 is provided on the opposite side of the photoreceptor drum 36 in the vertical direction.

Further, as illustrated in FIGS. 8A to 8C, the elastic portion 702 is formed in a substantially long plate shape extending in the longitudinal direction (front-rear direction) of the development unit 64, and includes a first incline 702*a*, a second incline 702*b*, and a long hole 702*c*. The first incline 702*a* is formed in a flat plate shape, and inclines to approach the right side, that is, the transfer unit 42 (first guide member 424) toward the back side in the insertion direction of the development unit 64 (from the front side toward the back side). The second incline 702*b* is formed in a flat plate shape, is formed on the back side of the first incline 702*a* (the back side in the insertion direction of the development unit 64), and inclines to approach the left side, that is, the development unit 64 (a main body of the second guide member 70) toward the back side in the insertion direction of the development unit 64. The first incline 702*a* and the second incline 702*b* constitute the main body of the elastic portion 702. Accordingly, the elastic portion 702 is formed in a substantially U shape (V shape) that opens toward the development unit 64 (left side) when viewed from above (below). That is, the elastic portion 702 is formed to open toward the second guide member 70 where the elastic portion 702 is provided and to protrude toward the first guide member 424 where the elastic portion 702 is not provided.

Further, an end of the second incline 702*b* on the back side (the back side in the insertion direction of the development unit 64) is coupled to the main body of the second guide member 70 via a coupling portion (bending portion) 702*d*. However, the second incline 702*b* is provided to be inclined at a predetermined angle θ (for example, 30°) with respect to the main body of the second guide member 70.

The long hole 702*c* is a long hole (slot hole) formed over the first incline 702*a* and the second incline 702*b* and extending in the front-rear direction. The long hole 702*c* is also formed at a substantially center in the width direction (vertical direction) of the elastic portion 702.

Figure 9:
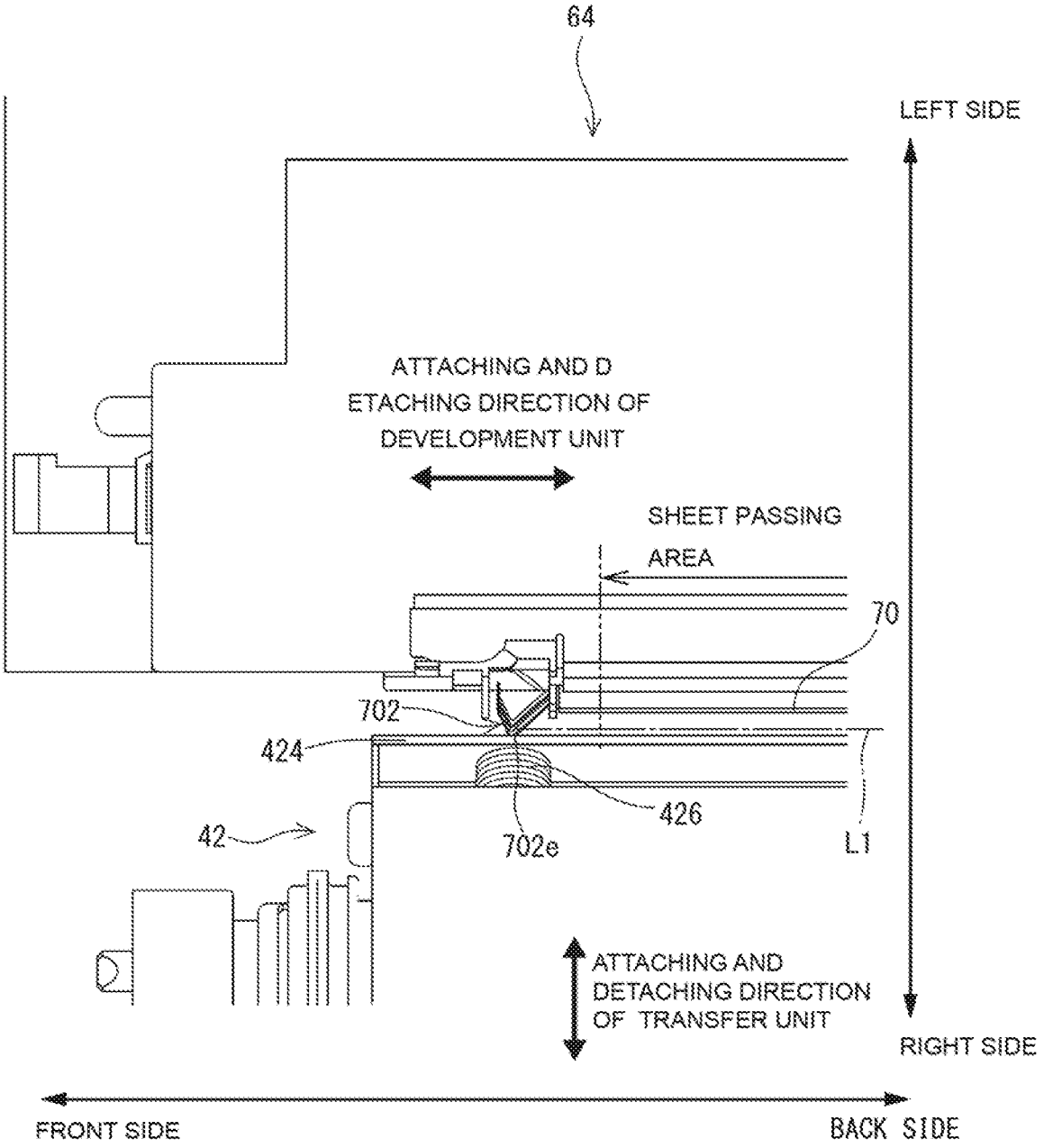
FIG. 9 is an illustrative view illustrating a relationship between a first guide member and the second guide member.

As illustrated in FIG. 9, the elastic portion 702 is placed at a position facing the first guide member 424, and abuts against the first guide member 424 in a state where the development unit 64 and the transfer unit 42 are attached to the apparatus main body 12. Specifically, a coupling portion (bending portion) 702*e* that couples the first incline 702*a* and the second incline 702*b* abuts (presses) against the first guide member 424.

Further, the elastic portion 702 is elastically deformable around the bending portion 702*d* that couples the first incline 702*a* and the main body of the second guide member 70, and also elastically deformable around the coupling portion 702*e* that couples the first incline 702*a* and the second incline 702*b*. That is, the elastic portion 702 is elastically deformable in the front-rear direction and in the left-right direction (the attaching and detaching direction of the development unit 64 and the attaching and detaching direction of the transfer unit 42).

Accordingly, either in a case where the transfer unit 42 is attached to and detached from the apparatus main body 12 with the development unit 64 attached to the apparatus main body 12 or in a case where when the development unit 64 is attached to and detached from the apparatus main body 12 with the transfer unit 42 attached to the apparatus main body 12, the elastic portion 702 (second guide member 70) and the first guide member 424 can reliably abuts against each other. That is, it is possible to provide conduction (electric connection) between the second guide member 70 and the first guide member 424. Accordingly, this makes it possible to ground the second guide member 70 and the first guide member 424 and bring the second guide member 70 and the first guide member 424 into the same potential, so that the surface potential of the paper sheet can be stabilized and transfer defects can be suppressed or prevented.

Further, in the first embodiment, since the elastic portion 702 is a plate spring, the second guide member 70 and the first guide member 424 can reliably abut against each other with a simple configuration.

Moreover, in the first embodiment, the elastic portion 702 is provided on the front side of the sheet passing area, that is, on the front side in the insertion direction of the development unit 64. Generally, a high-voltage board is placed on the back side of the apparatus main body 12. The elastic portion 702 provided on the front side of the sheet passing area can prevent the static elimination performance from being reduced due to the influence of such a high-voltage board.

Furthermore, in the first embodiment, the elastic portion 702 is provided integrally with the second guide member 70. Therefore, as compared with a case where the elastic portion 702 is provided as a separate member, it is possible to provide a simplified structure and also reduce a number of parts.

Further, in the first embodiment, the elastic portion 702 includes a first incline 702*a* that inclines to approach the transfer unit 42 (first guide member 424) toward the back side in the insertion direction of the development unit 64, and a second incline 702*b* that is continuously formed on the back side of the first incline 702*a* and inclines to approach the development unit 64 (the main body of the second guide member 70) toward the back side in the insertion direction of the development unit 64. Accordingly, the elastic portion 702 can be prevented from being caught by components around the elastic portion 702 either in the case where the transfer unit 42 is attached to and detached from the apparatus main body 12 or in the case where the development unit 64 is attached to and detached from the apparatus main body 12. This can prevent the component parts from being damaged (scratched), so that the development unit 64 and the transfer unit 42 can be attached to and detached from the apparatus main body 12 smoothly.

Further, in the first embodiment, the elastic portion 702 is provided on the opposite side of the photoreceptor drum 36 in the vertical direction. Accordingly, the elastic portion 702 or the photoreceptor drum 36 can be prevented from being damaged due to the elastic portion 702 and the photoreceptor drum 36 coming into contact with each other.

It is noted that, in the first embodiment, the elastic portion 702 is provided integrally with the second guide member 70, but it is not necessary to be limited to this. Although not illustrated, for example, the elastic portion 702 may be formed of a member separated from the second guide member 70. In this case, the member (elastic member) constituting the elastic portion 702 has conductivity, and the elastic portion 702 is fixed to the second guide member 70 by being fastened, welded, bonded, or the like.

Second Embodiment

The image forming apparatus 10 according to a second embodiment is the same as the image forming apparatus 10 according to the first embodiment except that an elastic portion is provided at the side of the transfer unit 42. Accordingly, different parts from the first embodiment will be described but the same explanation will be not repeated.

Figure 10:
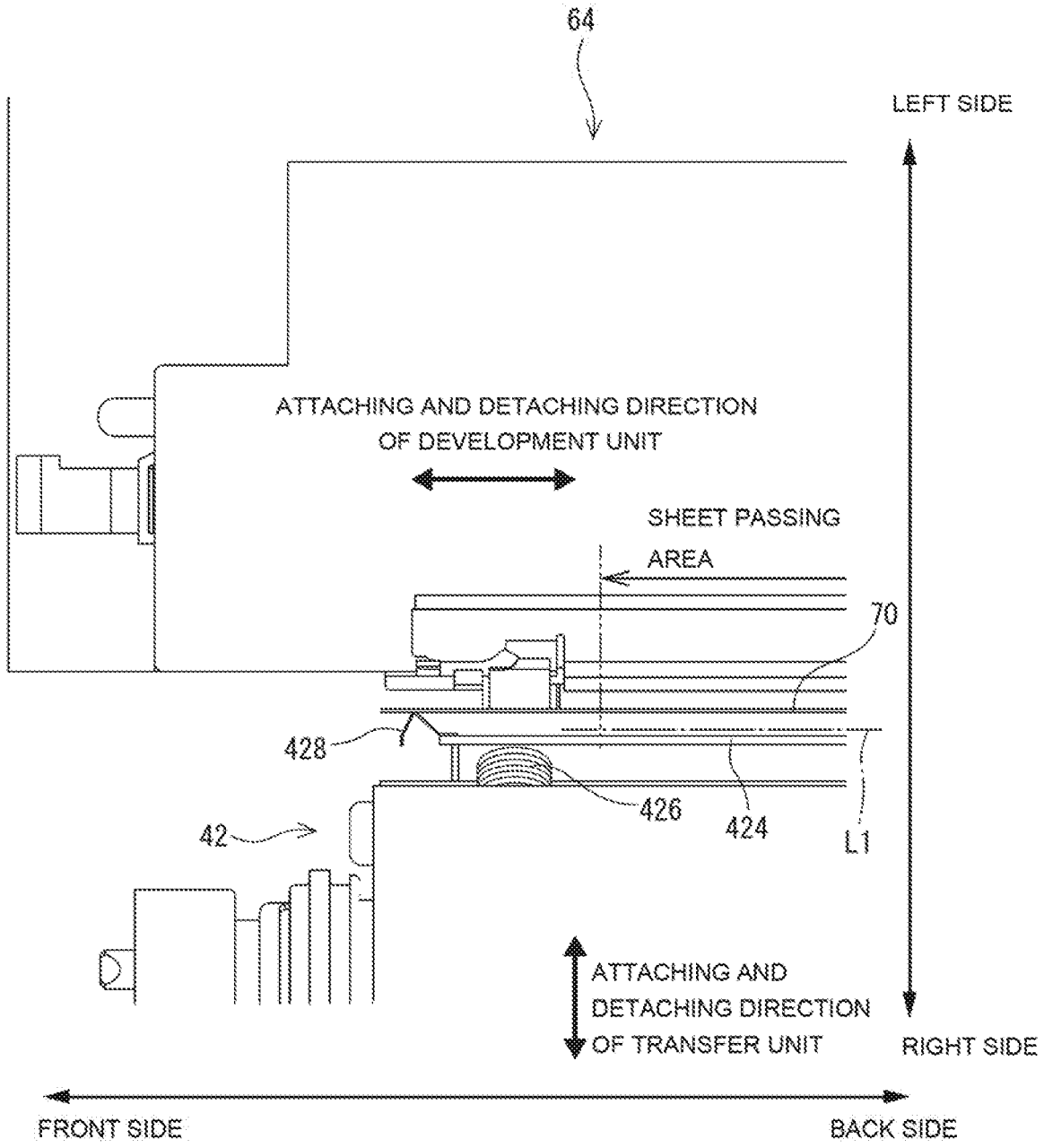
FIG. 10 is an illustrative view illustrating a configuration of an elastic portion according to a second embodiment and a relationship between the first guide member and the second guide member.

FIG. 10 is an illustrative view illustrating a configuration of an elastic portion 428 according to the second embodiment and a relationship between the first guide member 424 and the second guide member 70. As illustrated in FIG. 10, in the second embodiment, the elastic portion 702 is eliminated, and the elastic portion 428 is provided in place of the elastic portion 702.

The elastic portion 428 is formed of a member separated from the first guide member 424, and the member (elastic member) constituting the elastic portion 428 has conductivity. The elastic portion 428 is fixed to the first guide member 424 by being fastened, welded, bonded, or the like.

It is noted that the elastic portion 428 has the same configuration as the elastic portion 702 of the first embodiment except that its left-right direction is different (opposite). In brief, the elastic portion 428 is provided on the front side of the sheet passing area, and is provided at the lower end portion of the first guide member 424, which is difficult to be seen in FIG. 10. That is, the elastic portion 428 is provided on the opposite side of the transfer roller 422 in the vertical direction.

The elastic portion 428 also includes a first incline that inclines to approach the left side, that is, the development unit 64 (second guide member 70) toward the back side in the insertion direction of the development unit 64, and a second incline that is continuously formed on the back side of the first incline and inclines to approach the right side, that is, the transfer unit 42 (first guide member 424) toward the back side in the insertion direction of the development unit 64. Therefore, the elastic portion 428 is elastically deformable in the front-rear direction and in the left-right direction (the attaching and detaching direction of the development unit 64 and the attaching and detaching direction of the transfer unit 42).

According to the second embodiment, similarly to the first embodiment, it is possible to provide reliable conduction between the second guide member 70 and the first guide member 424.

It is noted that, in each of the above-described embodiments, the image forming apparatus 10 is configured as a multifunction peripheral, but the image forming apparatus of the present invention may be configured as a printer, a copying machine, or a facsimile.

Further, the specific shape and so on described in the above-described embodiments are examples, and their variations are possible according to an actual product as appropriate.

Furthermore, in the above-described embodiments, the elastic portion 702 is provided outside the sheet passing area and on the front side of the sheet passing area, but it is not necessary to be limited to this. For example, the elastic portion 702 (the same applying to the elastic portion 428) may be provided outside the sheet passing area and on the back side of the sheet passing area. Even in this case, similarly to the above-described embodiments, it is possible to provide reliable conduction between the second guide member 70 and the first guide member 424.

Furthermore, in the above-described embodiments, the elastic portion 702 is provided at the lower end portion of the second guide member 70 in the vertical direction, but it is not necessary to be limited to this. For example, the elastic portion 702 may be provided at the upper end portion or the center portion of the second guide member 70 in the vertical direction. Even in this case, similarly to the above-described embodiments, it is possible to provide reliable conduction between the second guide member 70 and the first guide member 424.

Further, in the above-described embodiments, the first incline 702*a* and the second incline 702*b* included in the elastic portion 702 (the same applying to the elastic portion 428) are formed in a flat plate shape, but the first incline 702*a* and the second incline 702*b* may be curved.

DESCRIPTION OF REFERENCE NUMERALS

10 Image forming apparatus
12 Apparatus main body
36 Photoreceptor drum
42 Transfer unit
422 Transfer roller
424 First guide member
64 Development unit
70 Second guide member
702 Elastic portion

What is claimed is:

1. An image forming apparatus, comprising:

an apparatus main body;

a development unit including an image carrier on which a toner image is formed, the development unit being attached to and detached from the apparatus main body in a longitudinal direction of the image carrier;

a transfer unit placed to face the image carrier, the transfer unit including a transfer roller that transfers the toner image onto a paper sheet, and the transfer unit being attached to and detached from the apparatus main body in a direction in which the image carrier and the transfer roller face each other;

a first guide member having conductivity and being provided in the transfer unit, the first guide member guiding the paper sheet to a transfer nip area formed by the image carrier and the transfer roller;

a second guide member having conductivity, being provided in the development unit, and being placed to face the first guide member, the second guide member guiding the paper sheet to the transfer nip area, at least one of the first guide member and the second guide member being grounded; and an elastic member being provided between the first guide member and the second guide member, being placed outside a sheet passing area through which the paper sheet passes, the elastic member electrically connecting the first guide member and the second guide member, wherein the elastic member is elastically deformable in an attaching and detaching direction of the development unit and in an attaching and detaching direction of the transfer unit.

2. The image forming apparatus according to claim 1, wherein the elastic member is a plate spring.

3. The image forming apparatus according to claim 1, wherein the elastic member is provided on a front side of the sheet passing area in an insertion direction of the development unit.

4. The image forming apparatus according to claim 1, wherein the elastic member is provided integrally with the second guide member.

5. The image forming apparatus according to claim 4, wherein the elastic member includes a first incline that inclines to approach the first guide member as the first incline moves toward a back side in the insertion direction of the development unit, and a second incline that is formed on the back side of the first incline in the insertion direction of the development unit and inclines to approach the second guide member as the second incline moves toward the back side in the insertion direction of the development unit, and a coupling portion between the first incline and the second incline of the elastic member abuts against the first guide member.

6. The image forming apparatus according to claim 1, further comprising an urging member provided in the transfer unit, the urging member urging the second guide member in a direction toward the development unit.

* * * * *